US007815214B2

(12) United States Patent
Sabol

(10) Patent No.: US 7,815,214 B2
(45) Date of Patent: Oct. 19, 2010

(54) ROTATABLE SPORTS BOARD BINDING ADAPTER

(76) Inventor: Jeffrey P. Sabol, P.O. Box 826, Indian Hills, CO (US) 80454

( * ) Notice: Subject to any disclaimer, the term of this patent is extended or adjusted under 35 U.S.C. 154(b) by 849 days.

(21) Appl. No.: 11/302,632

(22) Filed: Dec. 14, 2005

(65) Prior Publication Data

US 2006/0091622 A1 May 4, 2006

Related U.S. Application Data

(63) Continuation-in-part of application No. 10/658,309, filed on Sep. 9, 2003, now Pat. No. 6,994,370.

(51) Int. Cl.
*A63C 9/02* (2006.01)

(52) U.S. Cl. ..... 280/618; 280/634

(58) Field of Classification Search ..... 280/617, 280/618, 623, 625, 626, 629, 634, 14.21, 280/14.22, 14.24
See application file for complete search history.

(56) References Cited

U.S. PATENT DOCUMENTS 3,915,466 A * 10/1975 Matsuda ..... 280/617
4,008,910 A * 2/1977 Roche ..... 285/153.1
4,788,746 A * 12/1988 Idler ..... 16/297
4,846,013 A * 7/1989 Iwasaki ..... 74/531
4,993,280 A * 2/1991 Olkoski et al. ..... 74/553
5,020,518 A * 6/1991 Spears et al. ..... 601/116
5,054,807 A * 10/1991 Fauvet ..... 280/607
5,354,088 A * 10/1994 Vetter et al. ..... 280/618
5,362,056 A * 11/1994 Minotti ..... 473/251
5,577,755 A * 11/1996 Metzger et al. ..... 280/607
5,762,358 A * 6/1998 Hale ..... 280/607
5,803,481 A * 9/1998 Eaton et al. ..... 280/633
5,820,155 A * 10/1998 Brisco ..... 280/607
5,832,784 A * 11/1998 McCallips et al. ..... 74/512
5,923,241 A * 7/1999 Cascan Garvalos ..... 338/162
6,007,085 A * 12/1999 Rigal et al. ..... 280/607
6,022,041 A * 2/2000 Dailey et al. ..... 280/618
6,155,591 A * 12/2000 Huffman et al. ..... 280/618
6,203,051 B1 * 3/2001 Sabol ..... 280/607
6,234,494 B1 * 5/2001 Gien ..... 280/14.24
6,272,964 B1 * 8/2001 Heilshov ..... 83/821
6,315,305 B1 * 11/2001 Gien ..... 280/14.24
6,318,749 B1 * 11/2001 Eglitis et al. ..... 280/607
6,491,310 B1 * 12/2002 Work ..... 280/14.24
6,753,635 B2 * 6/2004 Kuhlmann-Wilsdorf ..... 310/233
2004/0188983 A1 * 9/2004 Scholten ..... 280/618
2005/0034853 A1 * 2/2005 Robichaux et al. ..... 166/85.1

* cited by examiner

*Primary Examiner*—Frank B Vanaman
(74) *Attorney, Agent, or Firm*—Lathrop & Gage LLP

(57) ABSTRACT

A rotatable sports board binding adapter includes a base plate that forms a series of lock holes, and a rotatable plate that is rotatably connected to the base plate and is configured to receive a binding. The rotatable plate has a locking mechanism configured to engage any one of the lock holes. The adapter includes one or more low friction elements disposed between the base plate and the rotatable plate. A method for changing a range of rotation of a binding on a sports board includes disengaging a rotation limiter, rotating the rotatable plate from a first range of rotation into a second range of rotation, and re-engaging the rotation limiter with the rotatable plate in the second range of rotation.

27 Claims, 9 Drawing Sheets

FIG. 2
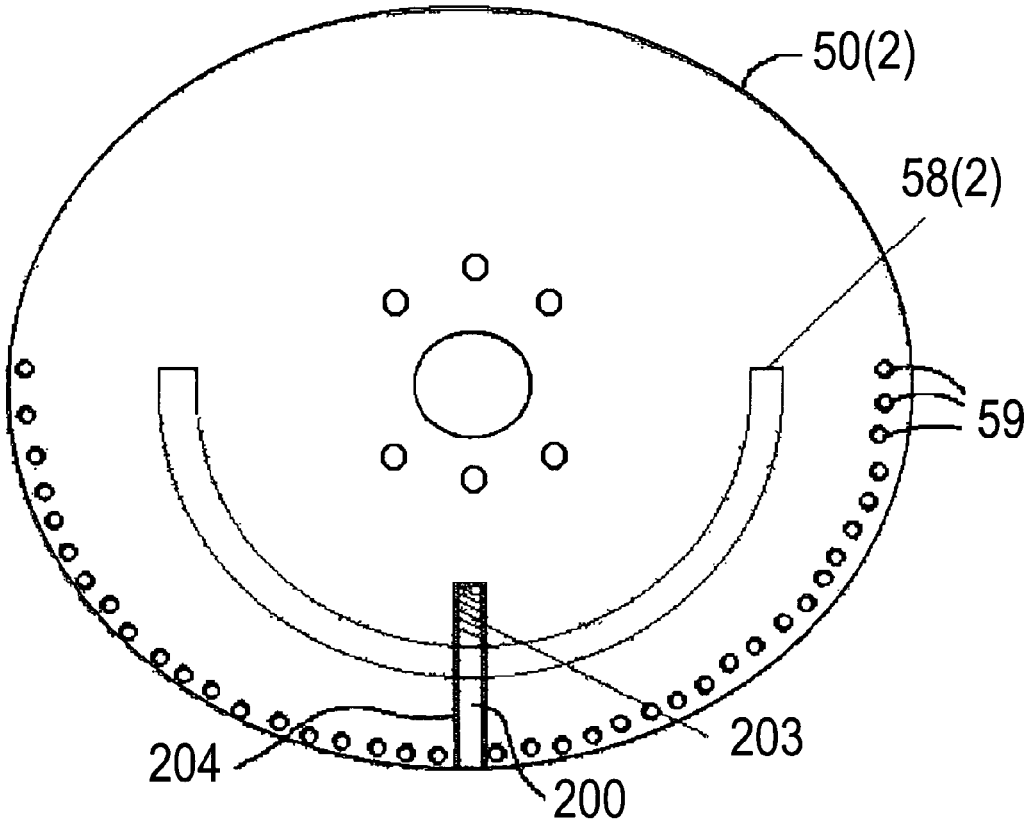
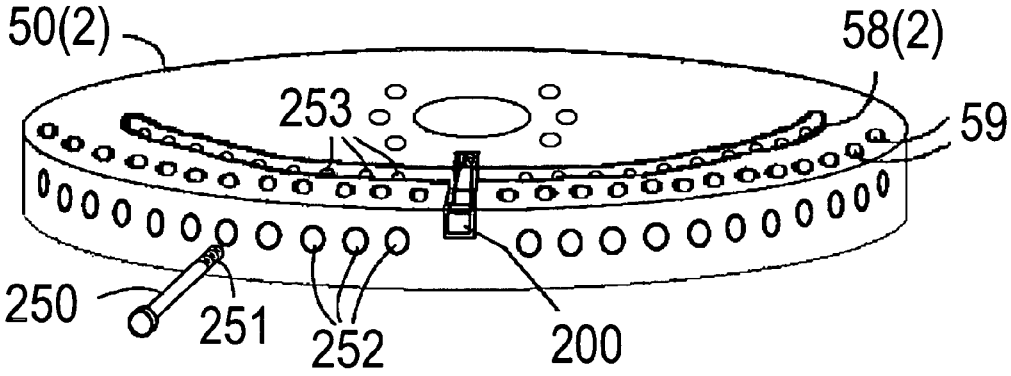
FIG. 3

FIG. 8A
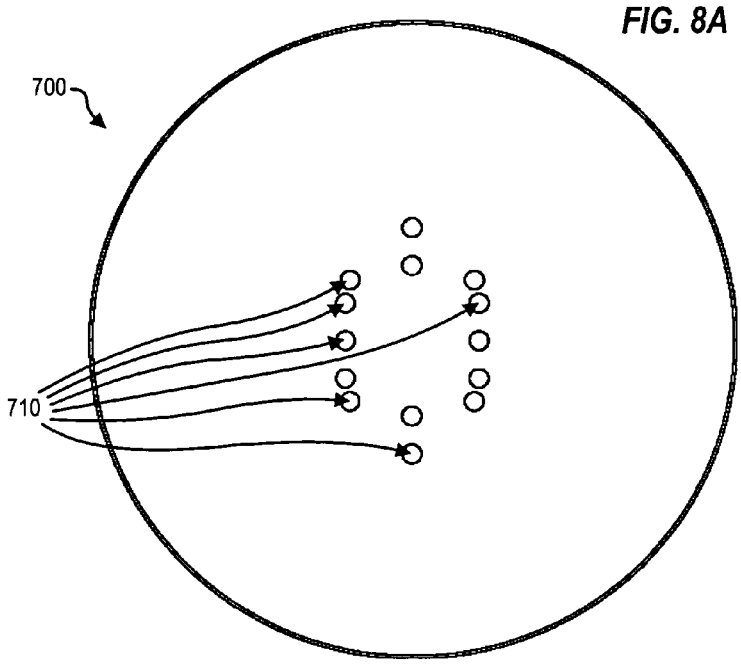
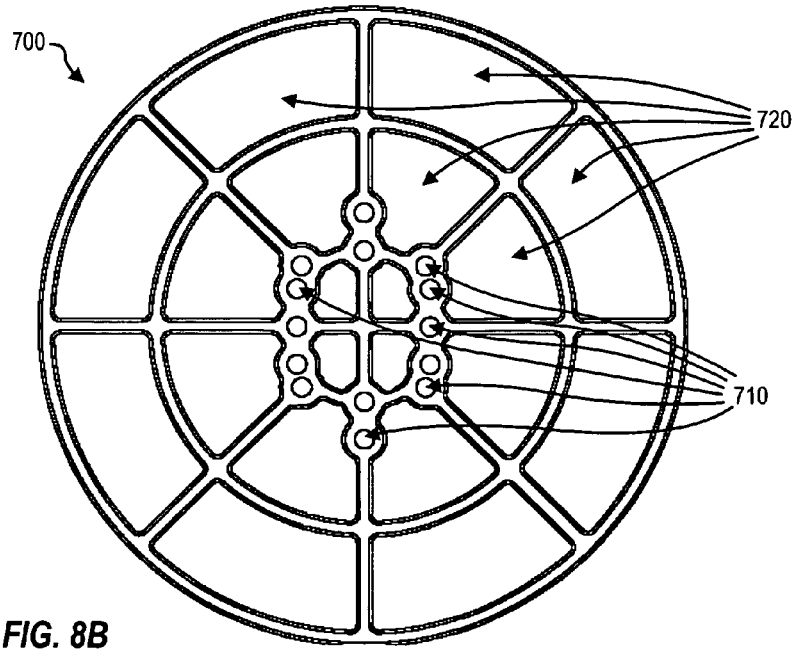
FIG. 8B

ROTATABLE SPORTS BOARD BINDING ADAPTER

CROSS-REFERENCE TO RELATED APPLICATIONS

This application is a continuation-in-part application of U.S. patent applications Ser. No. 10/658,309, filed 9 Sep. 2003 now U.S. Pat No. 6,994,370, and incorporated herein by reference.

BACKGROUND

Sports boards such as, for example waterboards, snowboards, wakeboards, skateboards, surfboards, sailboards and skateboard-type devices adapted for use on ice surfaces, may be used in sky, ground, water, ice, and snow related sports. Such sports boards typically use bindings to hold shoes or boots of a user to the board; the bindings are normally screwed onto the board in a permanent orientation that is almost perpendicular to the direction of travel of the board. This orientation is good for riding downhill on a snowboard, but may be uncomfortable when traveling over a flat or uphill snow contour, when it may be necessary to release the back boot and use that boot to propel the board. Having the front boot nearly perpendicular to the board with the board and back foot moving forward is uncomfortable and potentially dangerous because a fall in this orientation may injure the ankle or knee joints of the user. Furthermore, on a chairlift, having the foot nearly perpendicular to the board causes the board to be positioned across the front of the chair which may make mounting and dismounting the chairlift awkward, and may disturb or interfere with an adjacently seated rider.

SUMMARY OF THE INVENTION

A rotatable sports board binding adapter includes a base plate and a rotatable plate. The base plate forms a series of lock holes. The rotatable plate is rotatably connected to the base plate and is configured to receive a binding. The rotatable plate has a locking mechanism configured to engage any one of the lock holes. The adapter includes one or more low friction elements disposed between the base plate and the rotatable plate.

A method for changing a range of rotation of a binding on a sports board includes disengaging a rotation limiter that limits rotation of a rotatable plate on which the binding mounts, relative to a base plate that mounts to the sports board. The rotatable plate rotates from a first range of rotation into a second range of rotation. The rotation limiter re-engages with the rotatable plate in the second range of rotation.

BRIEF DESCRIPTION OF THE DRAWINGS

FIG. 2 shows a top view of one base plate for a rotatable sports board binding adapter.

FIG. 3 shows a perspective view of the base plate of FIG. 2.

FIG. 8A and FIG. 8B show top and bottom views, respectively, of a sports board binding mounting plate.

DETAILED DESCRIPTION OF THE DRAWINGS

Figure 1:
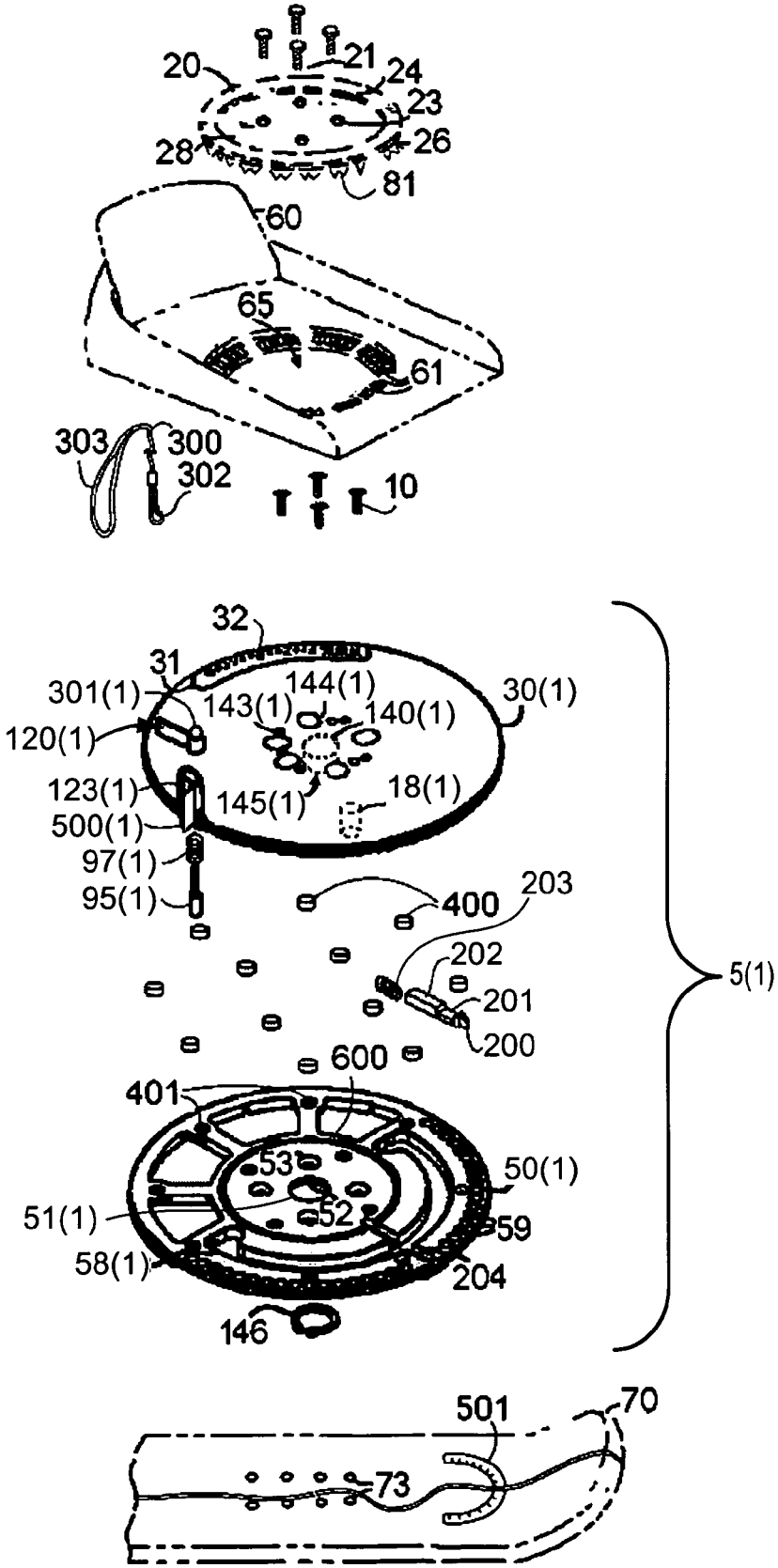
FIG. 1 is an exploded view of one rotatable sports board binding adapter that mounts between a standard board boot binding and a standard board.

FIG. 1 is an exploded view of a rotatable sports board binding adapter 5(1) that mounts between a standard board boot binding 60 and a standard board 70. FIG. 1 may not be drawn to scale. Adapter 5(1) has a base plate 50(1) that forms mounting holes 53 for mounting via screws or bolts 10 to a corresponding set of holes 73 in board 70. A rotatable plate 30(1) connects rotatably to base plate 50(1) by a cylindrical post 140(1) that extends downwardly from rotatable plate 30(1). Post 140(1) has an annular groove 145 that may receive a C-shaped spring clip 146 to connect the plates. Base plate 50(1) has a mating circular opening 51(1) for encircling post 140; the underside of base plate 50(1) may have a recess 52 about center opening 51(1) to accommodate C-shaped spring clip 146. Rotatable plate 30(1) has a set of access holes 144(1) that allow access to mounting holes 53 in base plate 50(1) so that screws or bolts 10 may attach adapter 5(1) to board 70.

Base plate 50(1) and rotatable plate 30(1) may be made, for example, of a non-rusting, durable material, such as metal (e.g., stainless steel, die cast aluminum), structurally durable molded or injected plastic, or combinations thereof (e.g., plastic molded about a metal frame). Base plate 50(1) and rotatable plate 30(1) may include a microscopically smooth finish such as nickel-molybdenum electroplating, for example to minimize wear on low friction elements (e.g., low friction pucks 400, low friction rings 220, and/or low friction bushings 610; see e.g., FIGS. 4, 5 and 6). The term "low friction element" herein denotes an element made of a low friction material such as, for example, nylon or Teflon®; the low friction material generates low friction when it slides against an opposing surface, and excludes arrangements of moving parts that are not fixed to a sliding surface or an opposing surface (e.g., ball bearings).

Use of low friction elements, and selection of the finish of rotatable plate 30(1) and base plate 50(1), may provide control over torque required to rotate plate 30(1) with respect to plate 50(1). For example, a snowboarder may find it inconvenient to rotate plate 30(1) with respect to plate 50(1) if the torque required to do so is greater than about 10 Newton-meters. Conversely, the snowboarder may find it hard to control rotation of plate 30(1) with respect to plate 50(1) if the torque required to do so is less than about 0.05 Newton-meters. In one embodiment, therefore, a rotatable sports board binding adapter 5 (e.g., any of rotatable sports board binding adapters 5(1)-5(3), see FIG. 4 through FIG. 6) requires torque of about 0.1 Newton-meters to about 5 Newton-meters to rotate plate 30(1) with respect to plate 50(1). In another embodiment, which provides an even more comfortable range of torque for a user thereof, rotatable sports board binding adapter 5 requires torque of about 0.3 Newton-meters to about 3 Newton-meters to rotate plate 30(1) with respect to plate 50(1).

In FIG. 1, a cap plate 20 (shown dashed) may secure boot binding 60 to the rotatable plate 30(1) so that binding 60 and plate 30(1) are fixed relative to each other. Binding 60 forms a circular opening 65. Cap plate 20 has an elevated peripheral rim 26 about a depression 24, and a downwardly protruding circular bottom 28 that is smaller in diameter than circular opening 65, so that a bottom 28 of cap plate 20 may fit into circular opening 65 and contact rotatable plate 30(1). Cap plate 20 forms a set of holes 23 that accommodate a set of bolts or screws 21 for securing cap plate 20 to rotatable plate 30(1). Rotatable plate 30(1) forms a set of threaded holes 143(1) that receive bolts or screws 21; threaded holes 143(1) may form patterns corresponding to industry standard layouts for bindings, such as a square four hole pattern, a diamond four hole pattern, and/or a three hole triangle pattern. A set of top teeth 81 of cap plate 20 interlock with a set of bottom teeth 61 of binding 60, thereby locking binding 60 to rotatable plate 30(1).

FIG. 1 also shows a locking mechanism 120(1) that may lock in a "down" position, engaging base plate 50(1) and rotatable plate 30(1). In the "down" position, a locking shaft 95(1) engages one of a set of lock holes 59 formed by base plate 50(1). FIG. 1 shows a set of lock holes 59 over about half the circumference of base plate 50(1), but it is appreciated that lock holes 59 may extend over a greater or lesser amount of the circumference of a base plate 50. For example, a set of lock holes 59 that extends about the entire circumference of a base plate may provide flexibility for installers or rental businesses to mount the base plate in any orientation on a snowboard. Furthermore, a rotatable sports board binding adapter 5 may have more than one locking mechanism 120 for improved mechanical integrity; for example, one such mechanism 120 can act as a backup should the other mechanism 120 fail. Multiple mechanisms 120 may be placed adjacent to each other about the circumference of a rotatable plate 30 (e.g., any of rotatable plates 30(1)-30(3), see FIG. 4-FIG. 6). Alternatively, mechanisms 120 may be placed separate from each other (for example, at about 180 degrees from each other about the circumference of a rotatable plate 30).

Shaft 95(1) of locking mechanism 120(1) secures rotatable plate 30(1) to base plate 50(1), holding binding 60 stationary with respect to base plate 50(1) at a desired angle of rotation with respect to board 70. Locking mechanism 120(1) may also lock in an "up" position so that rotatable plate 30(1) and binding 60 may rotate (e.g., by human intervention) relative to base plate 50(1) and board 70; when locked in the "up" position, locking mechanism 120(1) need not be held in the "up" position by a user of board 70.

FIG. 1 also shows a rotation limiting stop 200 that is positionable within a slot 204 formed in base plate 50(1). Base plate 50(1) forms an arc-shaped passageway 58(1) that defines a rotation limit of rotatable plate 30(1) with respect to base plate 50(1). In the embodiment of FIG. 1, passageway 58(1) is symmetric about post 140(1), and defines a maximum rotation limit of, about 180 degrees. Passageway 58(1) may extend partially or completely through base plate 50(1) without departing from the scope hereof.

In other embodiments, a passageway may be configured as a cutout of a base plate 50 (e.g., any of base plates 50(1)-50(4), see FIG. 2 through FIG. 6). That is, a base plate 50 may include structure that forms one or more travel limits for a stop pin 18 as described below (e.g., base plate 50(4), FIG. 6, forms travel limits S(1)-S(4) for stop pin 18(2), FIG. 5).

Stop 200 may include a stop ridge 202 and a groove 201 that has about the same width as passageway 58(1); spring 203 biases stop 200 so that stop ridge 202 limits the travel of a stop pin 18(1) within passageway 58(1). Stop pin 18(1) attaches to rotatable plate 30(1) and extends downwardly therefrom into passageway 58(1); stop pin 18(1) may be permanently attached to plate 30(1), or it may be detachable, as described below in connection with FIG. 5. Stop pin 18(1), passageway 58(1) and stop ridge 202 of stop 200 thus cooperate to form a rotation limiter, limiting rotation of rotatable plate 30(1) relative to base plate 50(1) to a range of rotation. The range of rotation corresponds to an arc within which stop pin 18(1) moves before it reaches a travel limit formed by stop ridge 202 or an end of passageway 58(1). Stop 200 may be pushed in so that groove 201 aligns with passageway 58(1), allowing stop pin 18(1) to pass over stop 200 so that stop pin 18(1) can move from one portion of passageway 58(1) to another portion. This may be used, for example, by a rental business, which can select the range of rotation corresponding to a basic foot orientation (0-90 or 90-180 degrees) to accommodate preferences of different users.

Limiting the rotation of rotatable plate 30(1) with respect to base plate 50(1)-that is, limiting an angle through which binding 60 may rotate relative to board 70 when locking mechanism 120(1) is locked in the "up" position-may promote safety. For example, limiting the angle through which binding 60 may rotate relative to board 70 may prevent overextension of knee and/or ankle joints of a user of board 70 when a user pushes board 70 along flat or uphill terrain, and/or mounts or dismounts a chairlift. However, certain snowboard users may value convenience of allowing rotatable plate 30(1) to rotate without limitation and may choose to detach a stop pin 18 (e.g., see screw 650 that forms stop pin 18(2), FIG. 5).

Rotatable plate 30(1) may form one or more information bearing surfaces 31, as shown in FIG. 1. Information 32 on information bearing surface 31 may include, for example, advertising messages such as product names, phone numbers or websites, or a name, address and/or phone number of an owner of board 70. Information 32 may be affixed to surface 31 by any suitable means such as, for example, by writing, painting, affixing a label, imprinting, inscribing or molding information 32 thereon.

FIG. 1 also shows an optional rotation angle pointer 500(1) that may point to a current rotation angle on an optional angle scale 501 on board 70. Pointer 500(1) may be formed on or adjacent to locking mechanism 120(1), for example. Scale 501 may be, for example, a sticker applied to board 70, or may be formed by writing, painting, imprinting, inscribing or molding angle information on board 70.

Locking mechanism 120(1) may be "L-shaped" as shown in FIG. 1, to facilitate grasping by a user. A cord or handle 300 with a hand grip or a leg strap, such as, for example, a top end loop 303, may also attach to locking mechanism 120(1) by a bottom hook 302 and a top ring 301(1), as shown in FIG. 1, so that the user may grasp cord 300 to operate locking mechanism 120(1) from a standing position. It is appreciated that other configurations for attaching cords and/or handles to locking mechanism 120(1) are apparent and within the scope of this disclosure.

Base plate 50(1) may include an optional grease ring 600 to keep dirt away from the vicinity of post 140(1) between base plate 50(1) and rotatable plate 30(1). Base plate 50(1) may also include a series of indented openings 401 that accommodate low friction pucks 400, to reduce friction between base plate 50 and rotatable plate 30. Low friction pucks 400 may be made of a material such as nylon or Teflon®. Low friction pucks 400 may be cylindrical, as shown in FIG. 1, or may be shaped differently.

FIG. 2 shows a top view of a base plate 50(2) for a rotatable sports board binding adapter. FIG. 2 may not be drawn to scale. Base plate 50(2) forms passageway 58(2) and lock holes 59 that are used as described above with respect to passageway 58(1) and lock holes 59 as shown in FIG. 1. It is appreciated that although FIG. 2 shows base plate 50(2) with lock holes 59 over about half of its circumference, lock holes 59 may extend over a greater or lesser amount of the circumference of base plate 50(2). FIG. 2 also shows stop 200 biased by a spring 203 within slot 204 that are used as described above in connection with FIG. 1.

FIG. 3 shows a perspective view of base plate 50(2). FIG. 3 may not be drawn to scale. This view shows how base plate 50(2) forms a series of angle set screw holes 252 around the periphery of base plate 50(2); holes 252 continue on the other side of passageway 58(2) as threaded mating holes 253. A set screw 250 has end threads 251 that may screw into mating holes 253 so that set screw 250 protrudes across passageway 58(2), creating an additional travel limit for a stop pin (e.g., stop pin 18(1)). One or more set screws 250 may thus be used to further reduce a range of rotation through which a rotatable plate (e.g., rotatable plate 30(1)) can rotate relative to base plate 50(2).

Figure 4:
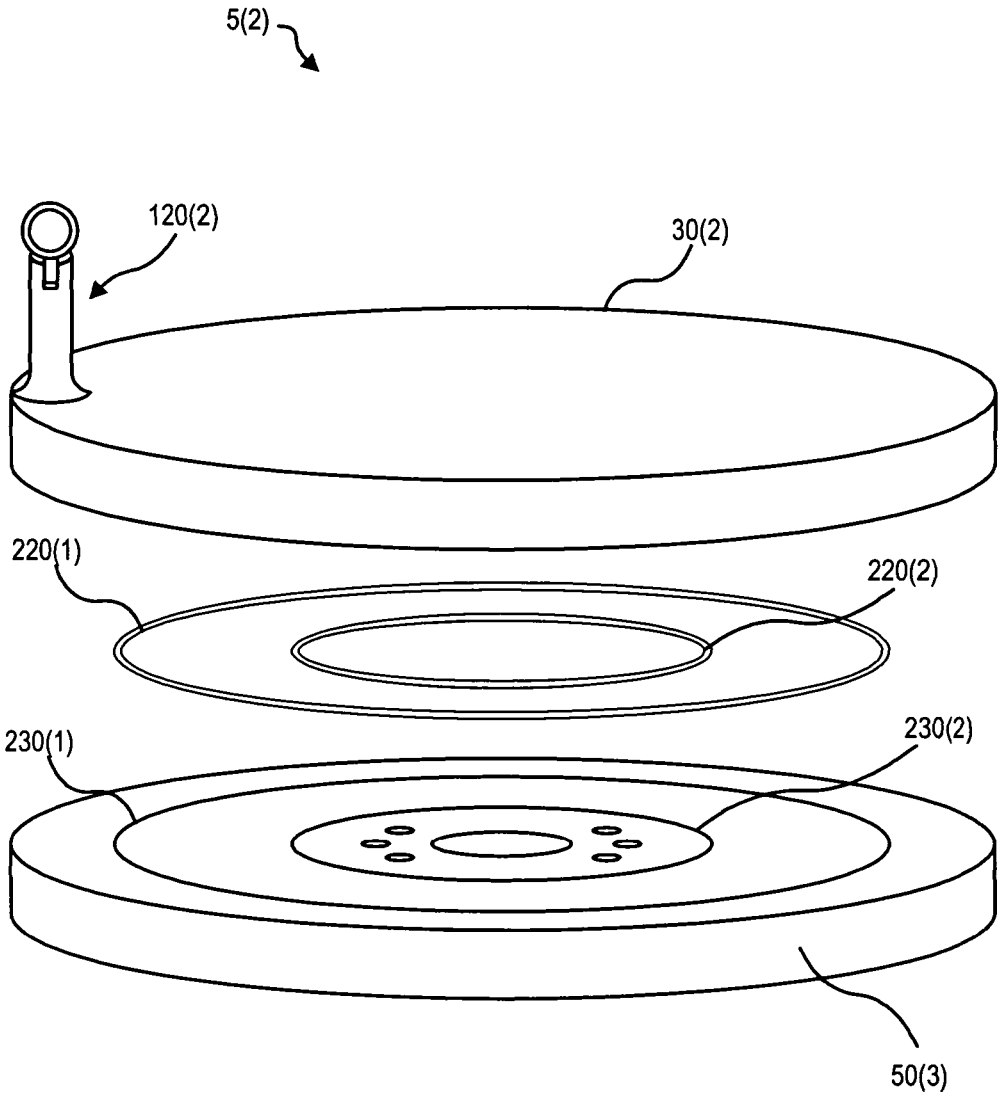
FIG. 4 shows an exploded view of one rotatable sports board binding adapter having a base plate and a rotatable plate.

FIG. 4 shows an exploded view of a rotatable sports board binding adapter 5(2) having a base plate 50(3) and a rotatable plate 30(2). FIG. 4 may not be drawn to scale. Adapter 5(2) does not utilize low friction pucks 400 (as in adapter 5(1), FIG. 1) but instead utilizes low friction rings 220(1) and 220(2) that seat in corresponding grooves 230(1) and 230(2) formed by base plate 50(3). Low friction rings 220 may be made of a material such as nylon or Teflon®. Low friction rings 220 may be more resistant to wear, and may be more effective at keeping dirt and other contaminants away from the vicinity of post 140(1), as compared to low friction pucks 400. It is appreciated that forming grooves in a base plate is one example of a configuration for seating low friction rings 220, and that alternatively, grooves may be formed in a rotatable plate, or in both of a base plate and a rotatable plate, for seating low friction rings 220.

Figure 5:
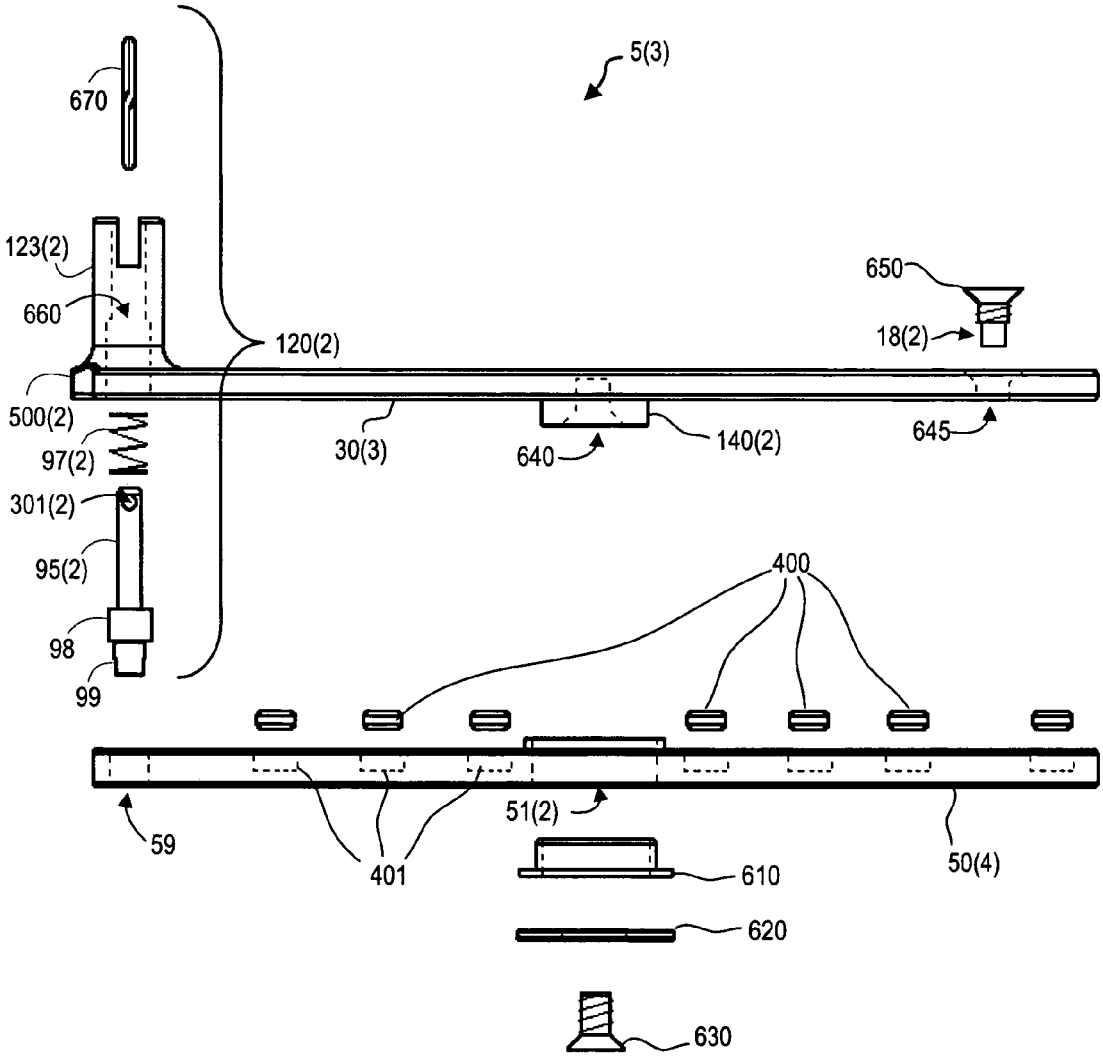
FIG. 5 shows an exploded side view of one rotatable sports board binding adaptor.

FIG. 5 shows an exploded side view of a rotatable sports board binding adaptor 5(3). FIG. 5 may not be drawn to scale. Adaptor 5(3) has a base plate 50(4) and a rotatable plate 30(3) that rotatably connect via a cylindrical post 140(2) of plate 30(3); post 140(2) fits into a mating circular opening 51(2) formed by base plate 50(4). A screw 630 and an optional washer 620 engage a hole 640 formed by post 140(2), securing base plate 50(4) to rotatable plate 30(3). A low friction bushing 610 fits about post 140(2) and reduces friction among base plate 50(4), washer 620 and post 140(2). Base plate 50(4) may include indented openings 401, each of which may receive a low friction puck 400 that reduces friction between base plate 50(4) and rotatable plate 30(3) (not all instances of indented openings 401 or pucks 400 are labeled in FIG. 5, for clarity of illustration). Dimensions of indented openings 401, low friction pucks 400 and/or low friction bushing 610 may be such that base plate 50(4) and rotatable plate 30(3) are not in direct contact with each other, thus reducing friction and eliminating a possibility of metal surface galling that might occur without low friction elements. It is appreciated that indented openings 401 and low friction pucks 400, grooves 230 and low friction rings 220, and low friction bushing 610, are examples of the incorporation of low friction elements; other configurations for incorporating low friction elements are apparent upon reading and fully appreciating this disclosure, and are thus included in the scope of this disclosure.

Rotatable plate 30(3) forms a hole 645 configured to engage a screw 650 that has a distal portion forming stop pin 18(2). When screw 650 engages hole 645, stop pin 18(2) limits rotation of rotatable plate 30(3) with respect to base plate 50(4) in the same manner described above (e.g., similar to stop pin 18(1) limiting rotation of rotatable plate 30(1) with respect to base plate 50(1), see FIG. 1). Removability of screw 650 and stop pin 18(2) facilitates reconfigurability of adapter 5(3) among ranges of rotation (e.g., to reconfigure a board utilizing adapter 5(3) for users who use a different foot orientation), and even makes disabling rotation limits possible, so that rotatable plate 30(3) can rotate without limitation.

Rotatable sports board binding adaptor 5(3) includes a locking mechanism 120(2) that has an outer sleeve 123(2). Sleeve 123(2) forms a locking shaft passageway 660. Within passageway 660, a spring 97(2) biases a locking shaft 95(2) by pushing a flange 98 towards base plate 50(4) (spring 97(2) and locking shaft 95(2) are shown below sleeve 123(2) only for illustrative purposes in the exploded view of FIG. 5). Locking shaft 95(2) may engage any of several lock holes 59 formed by base plate 50(4) (only one lock hole 59 is shown in dashed lines in FIG. 5, for clarity of illustration). A tip 99 of locking shaft 95(2) is tapered (see also FIG. 7) so that even when imperfectly centered within a lock hole 59 (e.g., because of wear, and/or torque exerted on adapter 5(3)) tip 99 can enter the lock hole 59, then hold rotatable plate 30(3) securely as spring 97(2) biases shaft 95(2) into a fully seated position within the lock hole 59. Locking shaft 95(2) forms a top ring 301(2) as shown; a split ring 670 may engage top ring 301(2) so that a user of adapter 5(3) can grasp split ring 670 to operate locking mechanism 120(2).

Rotatable plate 30(3) may also form a rotation angle pointer 500(2) adjacent to locking mechanism 120(2), for use with an angle scale to indicate a current rotation angle of rotatable plate 30(3) relative to a board (e.g., like pointer 500(1) indicates a current rotation angle on angle scale 501 of board 70, see FIG. 1).

Figure 6:
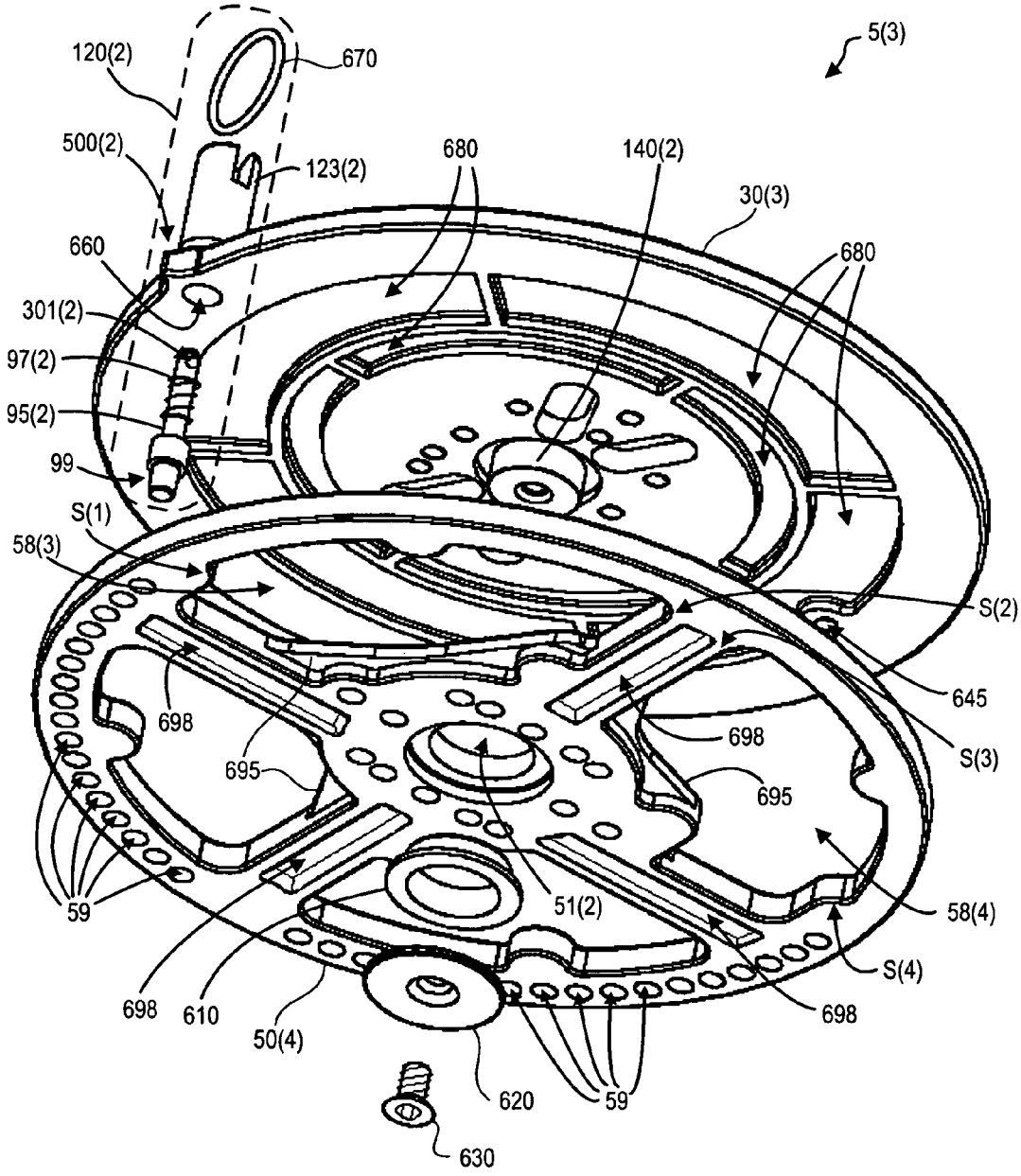
FIG. 6 shows an exploded perspective view of the rotatable sports board binding adapter of FIG. 5.

FIG. 6 shows an exploded perspective view of adapter 5(3). FIG. 6 may not be drawn to scale. Base plate 50(4) forms lock holes 59 and an opening 51(2), as shown. Only some lock holes 59 are labeled, for clarity of illustration; furthermore, it is appreciated that although FIG. 6 shows base plate 50(4) with lock holes 59 over about half of its circumference, lock holes 59 may extend over a greater or lesser amount of the circumference of base plate 50(4).

Base plate 50(4) forms passageways 58(3) and 58(4) within which stop pin 18(2) (see FIG. 5) can move as rotatable plate 30(3) rotates; base plate 50(4) thus sets travel limits for stop pin 18(2) at points labeled S(1)-S(4). For example, points S(1) and S(2) limit rotation of rotatable plate 30(3) to one specific arc of about 90 degrees with respect to base plate 50(4), while S(3) and S(4) limit rotation of rotatable plate 30(3) to a different arc of about 90 degrees with respect to base plate 50(4). It is appreciated that other base plates 50 may be configured to form travel limits for other angles, and lock holes 59 may be placed to allow a rotatable plate 30 to lock to the base plate 50 in specific orientations within the travel limits (see FIG. 10A-FIG. 10C).

Base plate 50(4) includes optional flanges 695 to increase strength of base plate 50(4), and forms optional recesses 698 to reduce weight of base plate 50(4). Rotatable plate 30(3) includes cylindrical post 140(2), rotation angle pointer 500(2) and an outer sleeve 123(2) that forms shaft passageway 660 for locking pin 95(2) and spring 97(2). Rotatable plate 30(3)

forms recesses 680 to reduce weight, and forms hole 645 that is configured to engage a screw that contains a stop pin (not shown in FIG. 6; see instead screw 650 and stop pin 18(2), FIG. 5). When screw 650 and stop pin 18(2) are installed, they cooperate with points S(1)-S(4) to limit rotation of rotatable plate 30(3) to defined ranges of rotation with respect to base plate 50(4). Alternatively, screw 650 and stop pin 18(2) may be removed so that rotation of rotatable plate 30(3) with respect to base plate 50(4) is not limited. Split ring 670, low friction bushing 610, washer 620 and screw 630 are also shown in FIG. 6; low friction pucks 400 (see FIG. 5) are hidden behind base plate 50(4) in this view. It is appreciated upon reading and fully appreciating this disclosure that flanges 695 and recesses 680 and 698 may be configured differently than illustrated in FIG. 6.

Figure 7A:
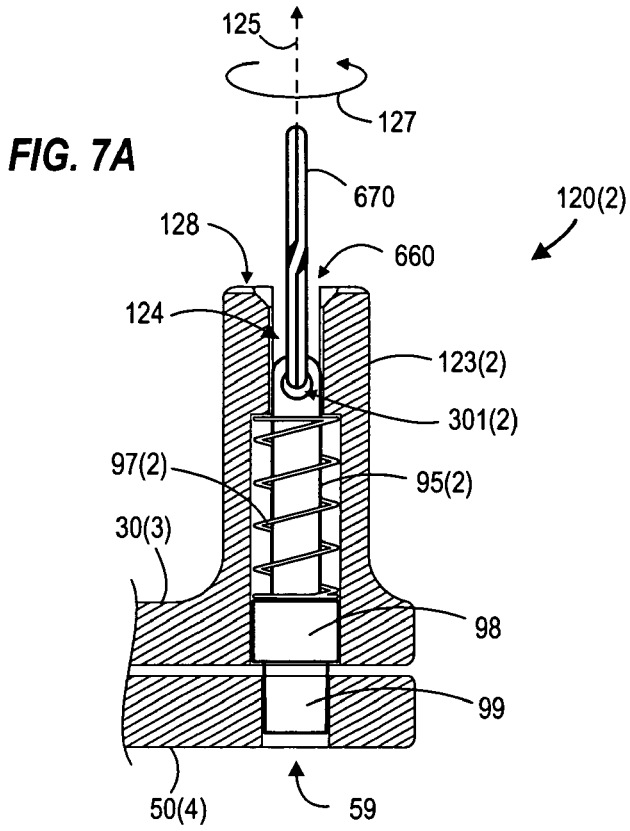
FIG. 7A and FIG. 7B are cross-sectional views that show the locking mechanism of the rotatable sports board binding adapter of FIG. 5 locked in the "down" and "up" positions, respectively.
Figure 7B:
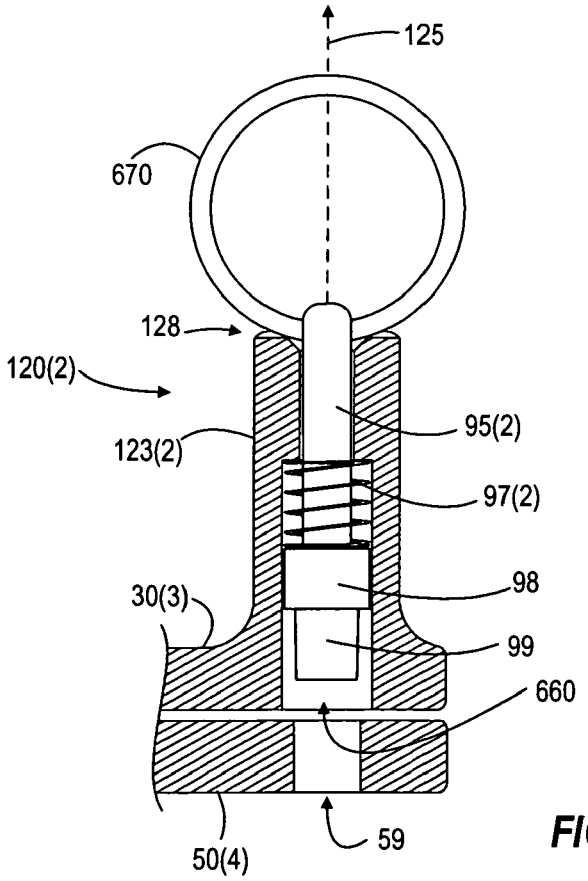

FIG. 7A and FIG. 7B are cross-sectional views that show locking mechanism 120(2) locked in the "down" and "up" positions, respectively. FIG. 7A and FIG. 7B may not be drawn to scale. Each of FIG. 7A and FIG. 7B show a portion of rotatable plate 30(3) that includes outer sleeve 123(2), a portion of base plate 50(4) that includes a lock hole 59, and elements of locking mechanism 120(2) including locking shaft 95(2) (including flange 98 and tip 99), spring 97(2), and split ring 670. Outer sleeve 123(2) forms passageway 660 and has an upper surface 128; shaft 95(2) may move within passageway 660 in both "up" and "down" directions (arrow 125 indicating the "up" direction); and may rotate within passageway 660, as indicated by arrow 127.

In FIG. 7A, locking shaft 95(2) is rotated such that split ring 670 aligns with a slot 124 formed by outer sleeve 123(2), so that spring 97(2) can bias shaft 95(2) in a "down" position with tip 99 engaging lock hole 59, as shown. In the "down" position, rotatable plate 30(3) locks in a selected angle of rotation relative to base plate 50(4) according to the lock hole 59 into which tip 99 locks; the "down" position may be used, for example, during downhill travel on a snowboard.

FIG. 7B, shows locking shaft 95(2) in an "up" position with tip 99 of shaft 95(2) disengaged from lock hole 59. To move shaft 95(2) from the "down" position shown in FIG. 7A into the "up" position shown in FIG. 7B, a user first pulls split ring 670 upwards (e.g., in the direction of arrow 125), compressing spring 97(2) and raising split ring 670 above upper surface 128 of outer sleeve 123(2). The user then rotates split ring 670 (e.g., twists split ring 670 in the direction of arrow 127, or in the opposite direction) so that split ring 670 no longer aligns with slot 124, but rests upon top surface 128 of outer sleeve 123(2) instead, holding shaft 95(2) in the "up" position. In the "up" position, rotatable plate 30(3) moves freely within the range of rotation allowed by the travel of stop pin 18(2) within one of passageways 58(3) or 58(4) (see also FIG. 6). The "up" position may be used, for example, while a user of a snowboard pushes the snowboard along flat terrain, or mounts or dismounts a chairlift. To move shaft 95(2) from the "up" position shown in FIG. 7B into the "down" position shown in FIG. 7A, a user rotates rotatable plate 30(3) such that shaft 95(2) is over a lock hole 59, and rotates split ring 670 so that it aligns with slot 124 of outer sleeve 123(2). Spring 97(2) then pushes shaft 95(2) into the "down" position, and tip 99 engages lock hole 59.

As discussed above in connection with FIG. 1, a rotatable sports board binding adapter 5 may have more than one locking mechanism 120 (e.g., either of mechanisms 120(1) or 120(2)) for improved mechanical integrity; for example, one such mechanism 120 can act as a backup should the other mechanism 120 fail.

FIG. 8A and FIG. 8B show top and bottom views, respectively, of a sports board binding mounting plate 700. FIG. 8A and FIG. 8B may not be drawn to scale. Plate 700 has mounting holes 710 for mounting a binding to plate 700 and for mounting plate 700 to a sports board, as shown; plate 700 may optionally have recesses 720 that extend only partially through plate 700, thereby reducing weight of plate 700 as compared to a plate 700 that does not have recesses 720. Plate 700 may be made, for example, of a non-rusting, durable material, such as metal (e.g., stainless steel, die cast aluminum), structurally durable molded or injected plastic, or combinations thereof (e.g., plastic molded about a metal frame).

Plate 700 may have a thickness that matches a thickness of a rotatable sports board binding adapter 5, and may be used as a fixed mounting plate for attaching one binding to a sports board, while a rotatable sports board binding adapter 5 is used to attach a second binding to the sports board. For example, an owner of a sports board may mount a front binding to the sports board using adapter 5 so that he or she can (1) disengage rotatable plate 30 from base plate 50 and release his or her foot from a rear binding during activities such as pushing the board along flat terrain, or riding a chairlift, and (2) engage rotatable plate 30 to base plate 50 at other times, and attach his or her foot to the rear binding at a fixed angle, with both bindings mounted at the same height above the board. Alternatively, an owner of a sports board may mount two bindings to the sports board using adapters 5 (for example, a rental business may wish to change the rotation angle of both bindings, to accommodate some users who use a "right-footed" orientation and other users who use a "left-footed" orientation).

Figure 9:
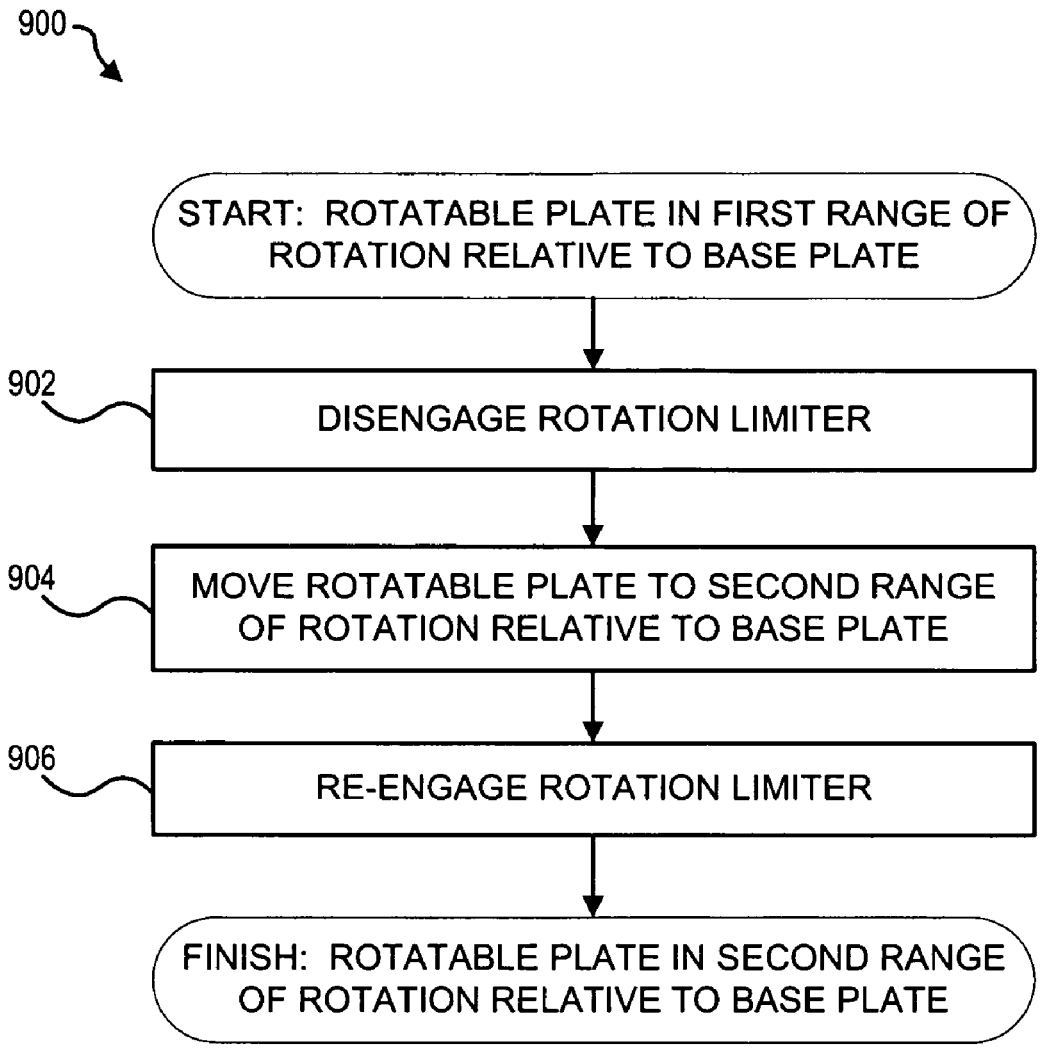
FIG. 9 is a flowchart illustrating a method for changing a range of rotation of a sports board.

FIG. 9 is a flowchart illustrating a method 900 for changing a range of rotation of a binding on a sports board. Method 900 may be performed, for example, using a rotatable sports board adapter 5 as described herein. Method 900 starts with a rotatable plate (e.g., rotatable plate 30) in a first range of rotation relative to a base plate (e.g., base plate 50). Step 902 disengages a rotation limiter. An example of step 902 is removing screw 650, as shown in FIG. 5 and FIG. 6, or pushing rotation limiting stop 200 so that groove 201 aligns with either of passageways 58(1) or 58(2) as shown in FIG. 1-FIG. 3. Step 904 rotates the rotatable plate relative to the base plate until the rotatable plate is in a second range of rotation relative to the base plate. An example of step 904 is turning rotatable plate 30(3) so that hole 645 moves from aligning with passageway 58(4) to aligning with passageway 58(3), as shown in FIG. 6, or turning rotatable plate 30(1) so that stop pin 18(1) crosses stop 200, as shown in FIG. 1 and FIG. 2. Step 906 re-engages the rotation limiter with the rotatable plate in the second range of rotation relative to the base plate. An example of step 906 is replacing screw 650, as shown in FIG. 5 and FIG. 6, or releasing stop 200 so that groove 201 no longer aligns with passageway 58(1), as shown in FIG. 1 and FIG. 2. Method 900 may be used, for example, by a sports board rental business to change the orientation of a sports board from "right-footed" to "left-footed" to accommodate the preference of a user.

Figure 10A:
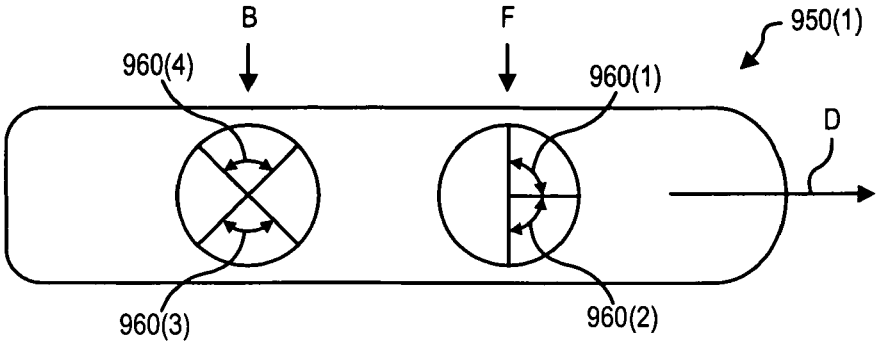
FIG. 10A illustrates ranges of rotation that may be implemented on a snowboard by utilizing rotatable sports board binding adapters of FIG. 1 through FIG. 6 and/or the sports board binding mounting plate of FIG. 8A and FIG. 8B.

FIG. 10A illustrates ranges of rotation 960(1)-960(4) that may be implemented on a snowboard 950(1) by utilizing rotatable sports board binding adapters 5 (e.g., any of adapters 5(1)-5(3)) and/or sports board binding mounting plate 700. Snowboard 950(1) has mounting areas denoted F and B for a front boot and a back boot, respectively. Snowboard users generally prefer to have their front boot at an angle of 90 degrees or less relative to a forward direction D in which the board moves, and their back boot pointing toward the same side of the board as the front boot. Different styles of use may be facilitated by different offsets between the angles of the front and back boots (see FIG. 10B and FIG. 10C). A user who uses his or her right foot forward may prefer to utilize, for example, range of rotation 960(1) for the front boot, and range of rotation 960(4) for the back boot. A user who uses his or her left foot forward may prefer to utilize, for example, range of rotation 960(2) for the front boot, and range of rotation 960(3) for the back boot. If a user owns snowboard 950(1), and does not wish to change back boot orientation for different uses (see FIG. 10B and FIG. 10C), he or she may utilize a rotatable sports board binding adapter 5 for the front boot (so that the front foot can be rotated forward for pushing along flats and for mounting and dismounting chairlifts) and a sports board binding mounting plate 700 for the back boot. If snowboard 950(1) is owned by a rental business, or by a user who wishes to change back boot orientation for different uses, rotatable sports board binding adapters 5 may be utilized for both the front boot and the back boot.

Figure 10B:
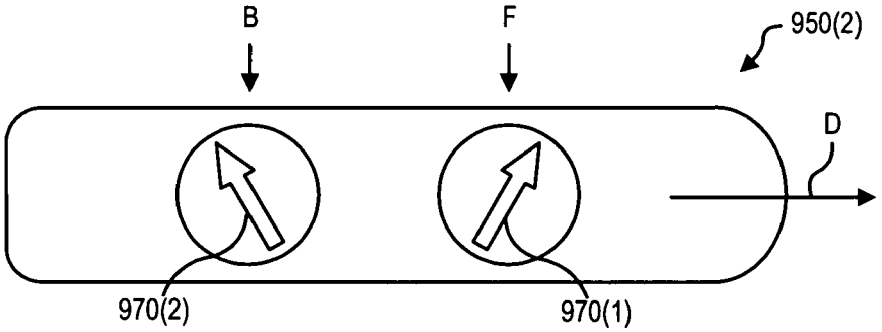
FIG. 10B illustrates boot orientations for a typical, recreational snowboard user who places his or her right foot towards the front of a snowboard.

FIG. 10B illustrates boot orientations for a typical, recreational snowboard user who places his or her right foot towards the front of a snowboard 950(2). Arrow 970(1) denotes the right foot orientation from heel to toe, and is at about a 60 degree angle with respect to forward direction D. Arrow 970(2) denotes the left foot orientation from heel to toe, and is at about a 60 degree angle with respect to arrow 970(1), or a 120 degree angle with respect to forward direction D. Many recreational snowboard users utilize this type of stance, that is, with the boots pointing outwards from each other and the back boot facing slightly backwards with respect to forward direction D. Comparing the orientations shown in FIG. 10B to the ranges of rotation illustrated in FIG. 10A, it may be seen that arrow 970(1) points in a direction within range of rotation 960(1) and that arrow 970(2) points in a direction within range of rotation 960(4).

Figure 10C:
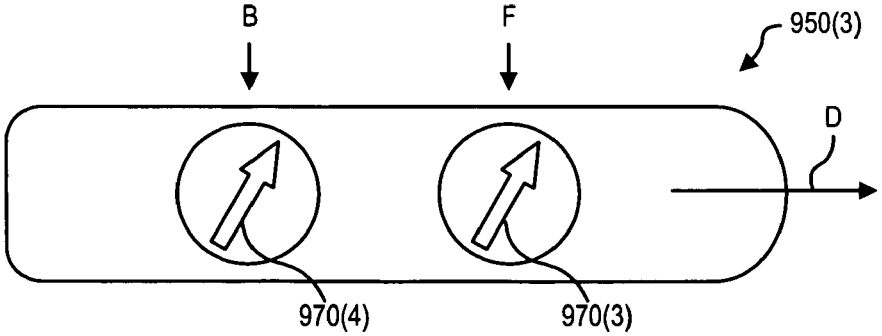
FIG. 10C illustrates boot orientations for a typical snowboard racer who places his or her right foot towards the front of a snowboard.

FIG. 10C illustrates boot orientations for a snowboard racer who places his or her right foot towards the front of a snowboard 950(3). Arrow 970(3) denotes the right foot orientation from heel to toe, and is at about a 60 degree angle with respect to forward direction D. Arrow 970(4) denotes the left foot orientation from heel to toe, and is parallel to arrow 970(3). Many snowboard racers utilize this type of stance, that is, with the boots pointing approximately parallel to each other and both boots facing slightly forward of perpendicular with respect to forward direction D. Comparing the orientations shown in FIG. 10C to the ranges of rotation illustrated in FIG. 10A, it may be seen that arrow 970(3) points in a direction within range of rotation 960(1) and that arrow 970(3) points in a direction within range of rotation 960(4). Therefore a user who prefers a racing stance at times and a recreational stance at other times can adjust between the two stances by utilizing a rotatable sports board binding adapter 5 to adjust the orientation of the back boot.

Since certain changes may be made in the above methods and systems without departing from the scope of the disclosure herein, one intention is that all matter contained in the above description or shown in the accompanying drawings be interpreted as illustrative and not in a limiting sense. By way of example, those skilled in the art will appreciate that the rotatable sports board adapter as described herein may be constructed, connected, arranged and/or applied in ways that are equivalent to what is shown. Accordingly, it is intended that the following claims be interpreted as encompassing all alterations, modifications, or alternative applications that fall within the spirit and scope of the invention.

What is claimed is:

1. A rotatable sports board binding adapter, comprising:

a base plate that forms (a) a series of lock holes, and (b) a passageway defining travel limits;

a rotatable plate rotatably connected to the base plate and configured to receive a binding, the rotatable plate having one or more locking mechanisms, each locking mechanism configured to engage any one of the lock holes;

a stop pin that passes within the passageway to limit rotation of the rotatable plate relative to the base plate when it contacts the travel limits, the stop pin configured for disengagement from the rotatable plate and re-engagement with the rotatable plate without disconnecting the rotatable plate from the base plate and without removing the base plate from the sports board; and one or more low friction elements disposed between the base plate and the rotatable plate.

2. The adapter of claim 1, the rotatable plate forming a hole for engaging a screw, a distal portion of the screw forming the stop pin.

3. The adapter of claim 1, the base plate forming cutouts that define two of the passageways.

4. The adapter of claim 1, the base plate comprising a series of angle set screw holes for receiving one or more set screws to form additional travel limits for the stop pin.

5. The adapter of claim 1, at least one of the locking mechanisms comprising a spring that biases a locking shaft towards the base plate.

6. The adapter of claim 5, the locking shaft comprising a tapered tip.

7. The adapter of claim 1, the one or more low friction elements comprising low friction pucks, one of the base plate and the rotatable plate forming one or more indented openings to accommodate the low friction pucks.

8. The adapter of claim 1, the one or more low friction elements comprising low friction rings, each of the low friction rings seating in respective grooves formed in one of the base plate and the rotatable plate.

9. The adapter of claim 1, the one or more low friction elements comprising a low friction bushing.

10. The adapter of claim 1, the one or more low friction elements configured so that the base plate and the rotatable plate are not in direct contact.

11. The adapter of claim 1, at least one of the base plate and the rotatable plate comprising a microscopically smooth finish to minimize wear on the low friction elements.

12. The adapter of claim 11, the finish comprising nickel-molybdenum electroplating.

13. The adapter of claim 1, at least one of the base plate and the rotatable plate having recesses to reduce weight of the adapter.

14. The adapter of claim 1, at least one of the base plate and the rotatable plate having partial thickness flanges.

15. The adapter of claim 1, the rotatable plate comprising an information bearing surface.

16. The adapter of claim 1, the rotatable plate forming a rotation angle pointer that points to a current rotation angle shown by an angle scale that forms part of the sports board.

17. The adapter of claim 1, wherein the lock holes extend about an entire circumference of the base plate.

18. The adapter of claim 1, requiring about 0.1 to 10 Newton-meters of torque to rotate the rotatable plate relative to the base plate.

19. The adapter of claim 18, requiring about 0.3 to 3 Newton-meters of torque to rotate the rotatable plate relative to the base plate.

20. A method for changing a range of rotation of a binding on a sports board, comprising:

disengaging a rotation limiter that limits rotation of a rotatable plate on which the binding mounts, to a first range of rotation comprising an arc relative to a base plate that mounts to the sports board by removing the rotation limiter from both the rotatable plate and the base plate, without disconnecting the rotatable plate from the base plate and without removing the base plate from the sports board;

rotating the rotatable plate from the first range of rotation into a second range of rotation comprising an arc that does not overlap the first range of rotation; and re-engaging the rotation limiter with the rotatable plate in the second range of rotation.

21. The method of claim 20 wherein removing the rotation limiter comprises removing a screw that forms the rotation limiter, the step of re-engaging comprising replacing the screw.

22. The method of claim 20, further comprising engaging a locking mechanism to lock the rotatable plate at a specific angle within one of the first and second ranges of rotation.

23. A method for changing a range of rotation of a binding on a sports board, comprising providing a base plate that mounts to the sports board, and a rotatable plate that is rotatably mounted to the base plate, the binding mounting to the rotatable plate, moving a rotation limiting stop that forms a groove along a slot of the base plate, to align the groove with a passageway of the base plate through which a stop pin of the rotatable plate moves, rotating the rotatable plate from a first range of rotation into a second range of rotation by passing the stop pin through the groove, and moving the rotation limiting stop so that the groove is not aligned with the passageway, thereby limiting the rotatable plate to the second range of rotation.

24. The method of claim 23, wherein limiting the rotatable plate to the second range of rotation comprises limiting rotation of the rotatable plate to an arc of about 90 degrees.

25. The method of claim 24, further comprising engaging a locking mechanism to lock the rotatable plate at a specific angle within the arc of about 90 degrees.

26. The method of claim 23, wherein moving the rotation limiting stop to align the groove with the passageway comprises compressing a spring between the rotation limiting stop and a surface of the base plate, and wherein moving the rotation limiting stop so that the groove is not aligned with the passageway comprises releasing the rotation limiting stop so that the spring decompresses.

27. A rotatable sports board binding adapter, comprising:

a base plate that forms a series of lock holes;

a rotatable plate rotatably connected to the base plate and configured to receive a binding, the rotatable plate having one or more locking mechanisms, each locking mechanism configured to engage any one of the lock holes; and one or more low friction elements disposed between the base plate and the rotatable plate, the one or more low friction elements comprising low friction pucks, one of the base plate and the rotatable plate forming one or more indented openings to accommodate the low friction pucks, each of the low friction pucks comprising a cylindrical shape consisting of a rounded side surface and two flat, unperforated ends, a first one of the ends contacting the rotating plate and the second of the ends contacting the base plate.

* * * * *